US010306391B1

(12) United States Patent
Choisel et al.

(10) Patent No.: US 10,306,391 B1
(45) Date of Patent: May 28, 2019

(54) STEREOPHONIC TO MONOPHONIC DOWN-MIXING

(71) Applicant: Apple Inc., Cupertino, CA (US)

(72) Inventors: Sylvain J. Choisel, Palo Alto, CA (US); Afrooz Family, Emerald Hills, CA (US); Brandon J. Rice, Pacifica, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/846,052

(22) Filed: Dec. 18, 2017

(51) Int. Cl.
*H04S 1/00* (2006.01)
*H04S 5/00* (2006.01)
*H04S 7/00* (2006.01)

(52) U.S. Cl.
CPC ..... *H04S 1/007* (2013.01); *H04S 5/00* (2013.01); *H04S 7/306* (2013.01); *H04S 2400/03* (2013.01)

(58) Field of Classification Search
CPC ..... H04H 40/81; H04S 1/007; H04S 5/00; H04S 7/306; H04S 2400/03
See application file for complete search history.

(56) References Cited

U.S. PATENT DOCUMENTS 7,522,733 B2 * 4/2009 Kraemer ..... H04S 1/002 381/1
7,542,815 B1 * 6/2009 Berchin ..... H04S 5/005 369/86
7,567,845 B1 7/2009 Avendano et al.
8,472,631 B2 * 6/2013 Klayman ..... H04S 3/002 381/1
8,553,892 B2 * 10/2013 Lindahl ..... H04S 5/00 381/1
9,088,855 B2 7/2015 Goodwin
9,093,063 B2 7/2015 Vilkamo et al.
9,105,265 B2 8/2015 Wu et al.
9,368,122 B2 6/2016 Kuntz et al.
9,672,839 B1 6/2017 Davis
2012/0020499 A1 1/2012 Neusinger et al.
2013/0262130 A1 10/2013 Ragot et al.
2017/0133034 A1 5/2017 Uhle et al.

FOREIGN PATENT DOCUMENTS

WO 2010097748 A1 2/2010

* cited by examiner

*Primary Examiner* — David L Ton
(74) *Attorney, Agent, or Firm* — Womble Bond Dickinson (US) LLP

(57) ABSTRACT

A transition between a stereophonic presentation and a monophonic presentation of a stereophonic input signal that includes a left channel signal and a right channel signal extracts content that is present at similar levels but not in-phase between the left and right channel signals to produce at least one of a left enhancement signal and a right enhancement signal. The left channel signal, the right channel signal, and only one of the left and right enhancement signals are combined to produce a monophonic signal for the monophonic presentation. Cross-fading between the left channel signal and the monophonic signal and between the right channel signal and the monophonic signal may be used to transition between the stereophonic presentation and the monophonic presentation. The stereophonic input signal may be up-mixed to produce enhancement signal. A similar transition between a multichannel presentation and a monophonic presentation of a multichannel signal is described.

22 Claims, 3 Drawing Sheets

STEREOPHONIC TO MONOPHONIC DOWN-MIXING

BACKGROUND

Field

Embodiments of the invention relate to the field of audio processing; and more specifically, to down-mixing of multi-channel audio to monophonic audio.

Background

Audio programs are frequently provided as multi-channel signals intended to be delivered by multiple speakers that are distributed in the listening environment. As an example, an audio program may be provided as a stereophonic signal having two channels intended to be delivered by two separated speakers or by headphones that deliver the two channels separately to the listener's two ears.

There may be times when it is desirable to present a multi-channel audio program as a monophonic presentation in which the audio program is delivered to a single speaker or delivered as identical signals to multiple speakers. This might occur when the audio device only has a single speaker, when the listener removes a headphone speaker from one ear, or when multiple speakers are being calibrated.

SUMMARY

A transition between a stereophonic presentation and a monophonic presentation of a stereophonic input signal that includes a left channel signal and a right channel signal extracts content that is present at similar levels but not in-phase between the left and right channel signals to produce at least one of a left enhancement signal and a right enhancement signal. The left channel signal, the right channel signal, and only one of the left enhancement signal and the right enhancement signal are combined to produce a monophonic signal for the monophonic presentation. Cross-fading between the left channel signal and the monophonic signal and between the right channel signal and the monophonic signal may be used to transition between the stereophonic presentation and the monophonic presentation. The stereophonic input signal may be up-mixed to produce the enhancement signal.

Other features and advantages of the present invention will be apparent from the accompanying drawings and from the detailed description that follows below.

BRIEF DESCRIPTION OF THE DRAWINGS

The invention may best be understood by referring to the following description and accompanying drawings that are used to illustrate embodiments of the invention by way of example and not limitation. In the drawings, in which like reference numerals indicate similar elements.

DETAILED DESCRIPTION

Figure 1:
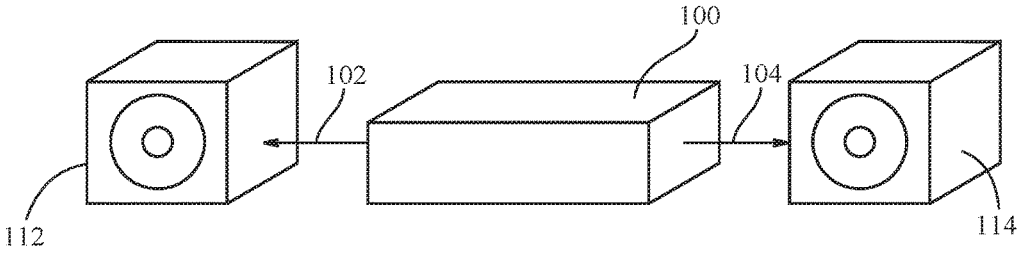
FIG. 1 is a view of an illustrative audio device and two speakers.

In the following description, numerous specific details are set forth. However, it is understood that embodiments of the invention may be practiced without these specific details. In other instances, well-known circuits, structures and techniques have not been shown in detail in order not to obscure the understanding of this description.

In the following description, reference is made to the accompanying drawings, which illustrate several embodiments of the present invention. It is understood that other embodiments may be utilized, and mechanical compositional, structural, electrical, and operational changes may be made without departing from the spirit and scope of the present disclosure. Functional elements that are a portion of a single component may be separately shown and described for clarity. Conversely, functional elements that are formed by multiple components, each of which may be used in full or in part to form the functional element, may be shown and described as a single element. The following detailed description is not to be taken in a limiting sense, and the scope of the embodiments of the present invention is defined only by the claims of the issued patent.

The terminology used herein is for the purpose of describing particular embodiments only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Conversion of a multi-channel audio program to a monophonic signal is usually done by summing the different channels into one with different multiplicative coefficients. This process is called "downward mixing" or "down-mixing."

The conventional technique for down-mixing the two channels of a stereo signal is:

$$M=0.707*L+0.707*R$$

where L is the left channel signal, R is the right channel signal, and M is the monophonic signal Down-mixing is standardized in Recommendation IRU-R BS.775-3 for five-channel multichannel content:

$$M=0.707*L+0.707*R+1.0*C+0.5*LS+0.5*RS$$

where C is the center channel, LS is the left surround channel, and RS is the right surround channel L, R, C, LS, and RS are the left, right, center, left-surround, and right-surround channels).

During the mastering of a stereo program, it is desirable to check that the stereo signals are mono compatible, i.e. that the result of down-mixing the stereo signals to a mono signal using the above equation would be an acceptable audio presentation of the stereo program.

In many music productions, however, this mono compatibility is violated. Effects may be used to create a wider sound image when rendered on a stereophonic playback system. Some elements of the music track may be out of phase in the left and right channels. There may also be some amount of de-correlation introduced, such as by the addition of artificial reverberation. When such content is summed to mono, the out-of-phase components will cancel out. Depending on the nature of the effect, the missing components may be reverberation or, more severely, a whole instrument or voice.

Mono compatibility requires consideration of the phase relationships throughout the audio spectrum between the left and right channels of a stereo recording. The nature of stereo means that there are time-arrival differences between the L and R channels of a stereo signal, this in part accounts for some of the spacious effects that make stereo music an enhanced listening experience over and above mono signals. Two microphones can sample the sound field from two positions in space and produce an effect which gives a sense of at least two dimensions when reproduced on two speakers/amplifiers each fed a discrete left and right signal. These timing differences mean that the signals between the left and right have a different and complex phase relationship relative to each other.

The approaches described below provides a more effective way to down-mix a multi-channel audio signal to a monophonic audio signal that lessen the cancellation of audio content in the multi-channel audio signal.

FIG. 1 is a view of an illustrative audio device 100 for presenting a stereophonic input signal. The audio device 100 may be coupled to one or more speakers 112, 114 that receive signals 102, 104 from the audio device and produce an audible audio presentation. The signals 102, 104 may be sent to the speakers 112, 114 by any of a variety of means, such as wires, optical fibers, or wireless communications. In some embodiments, the audio device 100 is coupled to a single speaker 112 that receives only one signal to produce the audible audio presentation.

Figure 2:
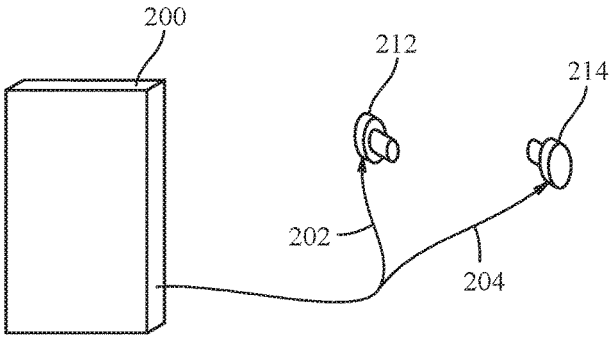
FIG. 2 is a view of another illustrative audio device and two personal speakers.

FIG. 2 is a view of another illustrative audio device 200 for presenting a stereophonic input signal. The audio device 200 may be coupled to a pair of personal speakers, which may be in the form of in-ear speakers 212, 214, headphones, ear buds, or other forms intended for use by a single listener. The signals 202, 204 may be sent to the speakers 212, 214 by any of a variety of means, such as wires or wireless communications.

Figure 3:
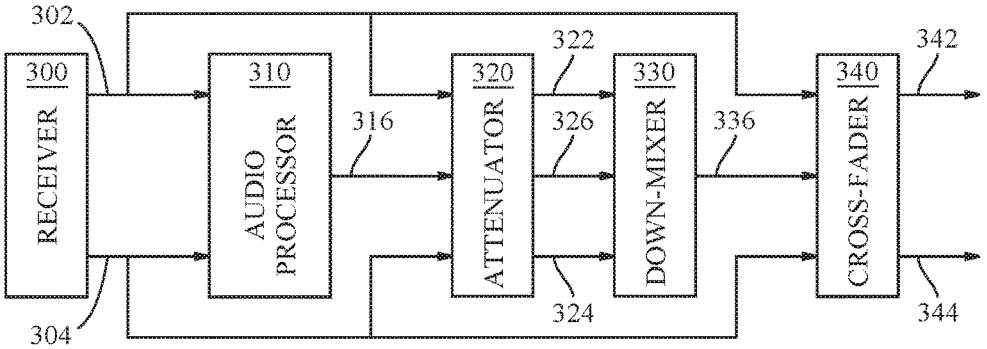
FIG. 3 is a block diagram of an audio signal processing system.

FIG. 3 is a block diagram of an audio signal processing system. A receiver 300 receives a left channel signal 302 and a right channel signal 304 for the stereophonic input signal. It will be appreciated that the labeling of the channel signals as left and right signals may be an arbitrary labeling that is not related to the position of the audio presentation represented by the channel signals or to the position of the speaker that produces the audible audio presentation from the channel signals.

An audio processor 310 receives the left channel signal 302 and the right channel signal 304. The audio processor 310 extracts content that is present at similar levels but not in-phase between the left and right channel signals 302, 304 to produce at least one of a left enhancement signal and a right enhancement signal to provide an enhancement signal 316.

For the purposes of this document, content in two signals is described as being "at similar levels but not in-phase" if the levels and phase relationships are such that adding the signals together electrically would result in an audible cancellation of the content. It will be appreciated that if the content is at the same levels and the phase differs by 180°, adding the signals together will result in a complete cancellation of the content. If the phase differs by less than or more than 180°, adding the signals together will result in a lesser cancellation of the content. If the phase difference is close to 0° or to 360°, the cancellation of the content from adding the signals together will become imperceptible to a listener. Likewise, as the level of the content in one of the two signals is reduced relative to the other, adding the signals together will result in a lesser cancellation of the content. The effect of level differences is additive to the effect of phase differences and the cancellation of the content from adding the signals together will become imperceptible to a listener at greater phase differences when there are level differences.

If the audio processor 310 produces both a left enhancement signal and a right enhancement signal, one the signals is chosen as the enhancement signal 316 to be used. Because the left and right enhancement signals include only content that is of similar levels in both channels, the choice of one of the signals as the enhancement signal 316 can be arbitrary.

An attenuator 320 may attenuate the left channel signal 302 and the right channel signal 304 by a first attenuation factor, such as an attenuation factor of 0.707. The enhancement signal 316 may be attenuated by a second attenuation factor different than the first attenuation factor. In some embodiments, the second attenuation factor may be 1.0, which means the enhancement signal 316 is not attenuated.

A down-mixer 330 receives the left channel signal 302, the right channel signal 304, and the enhancement signal 316 and mixes the signals, such as by summing the signals, to produce a monophonic signal 336. If an attenuator 320 is provided, the attenuated left channel signal 322, the attenuated right channel signal 324, and the attenuated enhancement signal 326 from the attenuator are mixed by the down-mixer 330 to produce the monophonic signal 336.

The attenuation factors may be chosen such that the audible audio presentation from the monophonic signal 336 sounds similar to the audible audio presentation from the left and right channel signals 302, 304. It will be appreciated that the audible audio presentation from the monophonic signal 336 can only approximate the audible audio presentation from the left and right channel signals 302, 304. Similarity between the monophonic and stereo presentations is a subjective determination that may vary between listeners and/or the stereophonic input signal being processed.

If the audio device 100 with two speakers 112, 114 is making a transition between a stereophonic presentation and a monophonic presentation of the stereophonic input signal, a cross-fader 340 may cross-fade between the left channel signal 302 and the monophonic signal 336 and between the right channel signal 304 and the monophonic signal 336 to produce the signals for the speakers 340, 342. This may mask the differences between the stereophonic presentation and the monophonic presentation.

Figure 4:
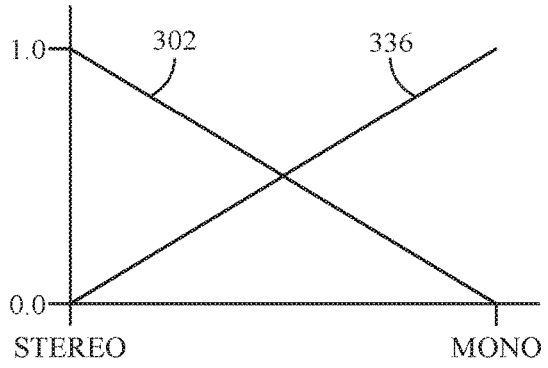
FIG. 4 is an illustrative graph showing a transition between a stereophonic presentation and a monophonic presentation.

FIG. 4 is an illustrative graph showing a transition between a stereophonic presentation and a monophonic presentation for the left channel. The cross-fader 340 fully attenuates the monophonic signal 336 while leaving the left channel signal 302 unattenuated for the stereophonic presentation, as illustrated at the left side of the graph. The cross-fader 340 fully attenuates the left channel signal 302 while leaving the monophonic signal 336 unattenuated for the monophonic presentation, as illustrated at the right side of the graph. In the transition between the stereophonic presentation and the monophonic presentation the signals gradually change between fully attenuated and unattenuated.

The cross-fader 340 combines the signals 302, 336, such as by addition, to produce a left speaker signal 342. While the transitions are shown as straight lines for clarity, they may be curves that are chosen to minimize audible changes in volume during the transition between the stereophonic presentation and the monophonic presentation. While the transition for the left channel is illustrated and described, it will be appreciated that the right channel is handled in the same way to produce a right speaker signal 344.

Figure 5:
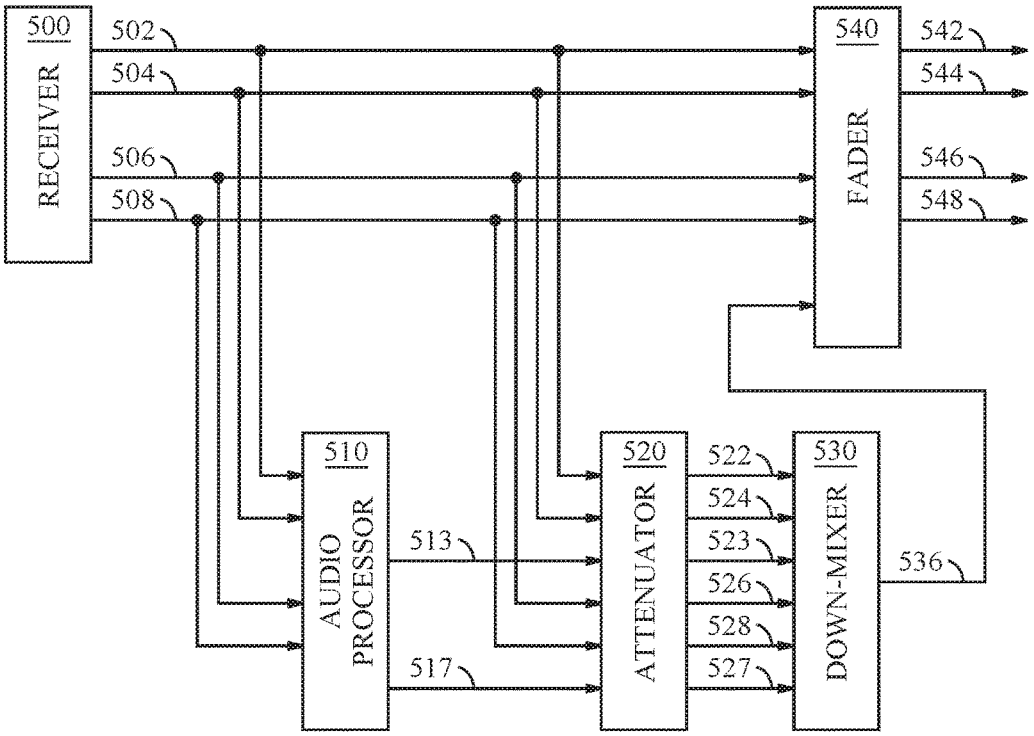
FIG. 5 is a block diagram of another audio signal processing system.

FIG. 5 is a block diagram of another audio signal processing system. A receiver 500 receives a multichannel input signal that includes a left channel signal 502, a right channel signal 504, a left surround channel signal 506, and a right surround channel signal 508. It will be appreciated that the labeling of the channel signals as left and right signals may be an arbitrary labeling that is not related to the position of the audio presentation represented by the channel signals or to the position of the speaker that produces the audible audio presentation from the channel signals. It will be appreciated that the multichannel input signal may include additional channels, such as ambient channels, a center channel, and/or a low-frequency enhancement channel.

An audio processor 510 receives the left and right channel signals 502, 504 and extracts content that is present at similar levels in the left and right channel signals 502, 504 but not in-phase to produce a first enhancement signal 513.

The audio processor 510 further receives the left and right surround channel signals 506, 508 and extracts content that is present at similar levels but not in-phase between the left and right surround channel signals 506, 508 to produce a second enhancement signal 517. The production of the enhancement signal for each pair of signals is similar to that described above for stereo signals.

An attenuator 520 may attenuate the left channel signal 502 and the right channel signal 504 by a first attenuation factor, such as an attenuation factor of 0.707. The left surround channel signal 506 and the right surround channel signal 508 may be attenuated by a second attenuation factor different than the first attenuation factor. In some embodiments, the second attenuation factor may be 1.0, which means the left and right surround channel signals 506, 508 are not attenuated. The enhancement signals 513, 517 may be attenuated by third and fourth attenuation factors different than the first attenuation factor.

A down-mixer 530 receives the left channel signal 502, the right channel signal 504, the left surround channel signal 506, the right surround channel signal 508, the first enhancement signal 513, and the second enhancement signal 517. The down-mixer 530 mixes, such as by summing the signals, the left channel signal 502, the right channel signal 504, the left surround channel signal 506, the right surround channel signal 508, the first enhancement signal 513, and the second enhancement signal 517, to produce a monophonic signal 536.

If an attenuator 520 is provided, the attenuated signals 522, 523, 524, 526, 527, 528 from the attenuator are mixed by the down-mixer 530 to produce the monophonic signal 536.

The attenuation factors may be chosen such that the audible audio presentation from the monophonic signal 536 sounds similar to the audible audio presentation from the multichannel input signal. It will be appreciated that the audible audio presentation from the monophonic signal 536 can only approximate the audible audio presentation from the multichannel input signal. Similarity between the monophonic and multichannel presentations is a subjective determination that may vary between listeners and/or the multichannel input signal being processed.

If the multichannel input signal includes a center channel signal, the center channel signal may be included in the down-mix. An included center channel signal may be attenuated by a fifth attenuation factor different than the first attenuation factor before being added to the down-mix. In some embodiments, the fifth attenuation factor may be 1.0, which means the center channel signal is not attenuated before being added to the down-mix.

If the multichannel input signal includes left and right ambient channel signals, the pair of ambient channels may be processed by the audio processor 510 to produce a third enhancement signal that is included in the down-mix. The ambient channel signals and the third enhancement signal may be attenuated before being added to the down-mix.

If an audio device with multiple speakers is making a transition between a multichannel presentation and a monophonic presentation of the multichannel input signal, a cross-fader 540 may cross-fade between signals for each of the channels of the multichannel presentation 502, 504, 506, 508 and the monophonic signal 536 to produce signals for each of the multiple speakers 542, 544, 546, 548 that transition between the multichannel presentation and the monophonic presentation. Cross-fading between the signals for each channel and the monophonic signal is similar to cross-fading between stereophonic signals and the monophonic signal as described above.

Figure 6:
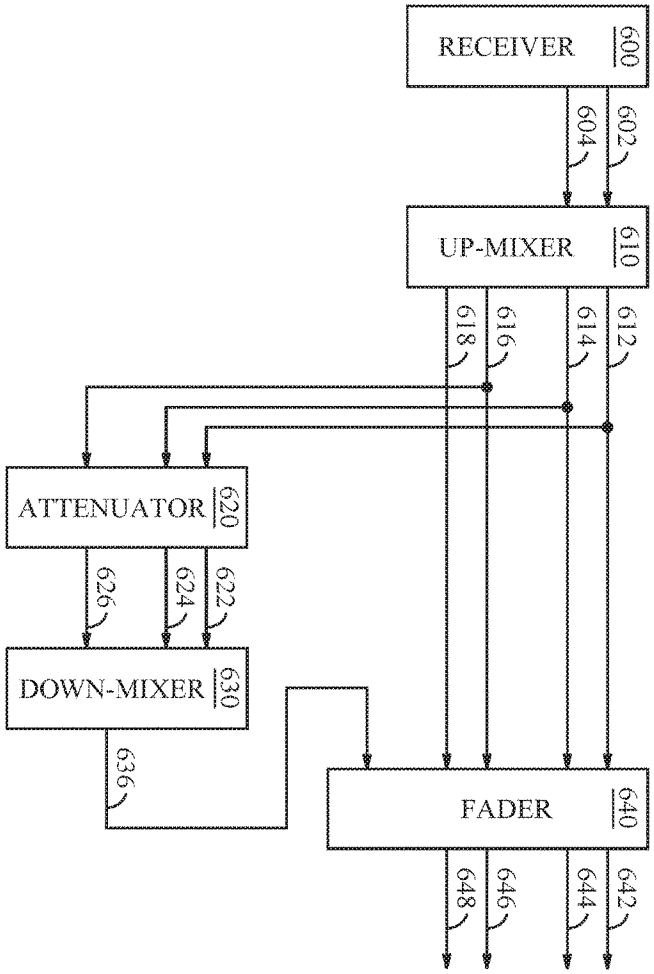
FIG. 6 is a block diagram of yet another audio signal processing system.

FIG. 6 is a block diagram of another audio signal processing system. A receiver 600 receives only a left stereo channel signal 602 and a right stereo channel signal 604 for a stereophonic input signal.

An up-mixer 610 receives the left and right stereo channel signals 602, 604 and performs audio processing to synthesize at least a left channel signal 612, a right channel signal 614, and at least one of a left surround channel signal 616, and a right surround channel signal 618. The left and right channel signals 612, 614 produced by up-mixing the stereophonic input signal may be identical to the left and right stereo channel signals 602, 604 as received. The up-mixer 610 may synthesize additional channels, such as ambient channels, a center channel, and/or a low-frequency enhancement channel. It will be appreciated that the labeling of the channel signals as left and right signals may be an arbitrary labeling that is not related to the position of the audio presentation represented by the channel signals or to the position of the speaker that produces the audible audio presentation from the channel signals.

The up-mixer 610 produces left and right surround channel signals 616, 618 that include similar content, at similar levels but not in-phase. Therefore one of the left and right surround channel signals 616, 618 produced by the up-mixer 610 may be processed similarly to the enhancement signal 316 produced by the audio processor 310 shown in FIG. 3 and described above. FIG. 6 shows the up-mixed left surround channel signal 616 being used as the enhancement signal.

An attenuator 620 may attenuate the up-mixed left and right channel signals 612, 614 by a first attenuation factor, and attenuate the enhancement signal 616 by a second attenuation factor different than the first attenuation factor. A down-mixer 630 mixes the attenuated left and right channel signals 622, 624, and the attenuated enhancement signal 626 to produce a monophonic signal 636. A cross-fader 640 may cross-fade between signals for each of the up-mixed channels of the multichannel presentation 612, 614, 616, 618 and the monophonic signal 636 to produce signals for each of the multiple speakers 642, 644, 646, 648 that transition between the multichannel presentation and the monophonic presentation. Additional details more fully described above for the systems shown in FIGS. 3 and 5 may also apply to the system shown in FIG. 6, While certain exemplary embodiments have been described and shown in the accompanying drawings, it is to be understood that such embodiments are merely illustrative of and not restrictive on the broad invention, and that this invention is not limited to the specific constructions and arrangements shown and described, since various other modifications may occur to those of ordinary skill in the art. The description is thus to be regarded as illustrative instead of limiting.

What is claimed is:

1. An audio device for presenting a stereophonic input signal, the audio device comprising:

a receiver that receives a left channel signal and a right channel signal for the stereophonic input signal;

an audio processor that extracts content that is present at similar levels but not in-phase between the left and right channel signals to produce at least one of a left enhancement signal and a right enhancement signal;

a down-mixer that combines the left channel signal, the right channel signal, and only one of the left enhancement signal and the right enhancement signal to produce a monophonic signal.

2. The audio device of claim 1, further comprising:

an attenuator that attenuates the left channel signal and the right channel signal by a first attenuation factor, and attenuates the one of the left enhancement signal and the right enhancement signal by a second attenuation factor different than the first attenuation factor;

wherein the down-mixer receives the left channel signal, the right channel signal, and the one of the left enhancement signal and the right enhancement signal from the attenuator.

3. The audio device of claim 1 further comprising a cross-fader that cross-fades between the left channel signal and the monophonic signal and between the right channel signal and the monophonic signal to cause the audio device to transition between a stereophonic presentation and a monophonic presentation of the stereophonic input signal.

4. The audio device of claim 1, wherein the audio processor includes an up-mixer that produces at least one of the left enhancement signal and the right enhancement signal by up-mixing the left channel signal and the right channel signal.

5. The audio device of claim 4, wherein the up-mixer further produces an identical left channel signal to the left channel signal and an identical right channel signal to the right channel signal by up-mixing the stereophonic input signal.

6. The audio device of claim 1, wherein the audio processor further adds the left channel signal and the right channel signal together; and determines a level of similarity for content that is present but not in phase between the left and right channel signals according to a cancellation of the content when the left channel signal and the right channel signal are added together.

7. The audio device of claim 6, wherein the audio processor extracts content with a high level of similarity between the left and right channel signals, wherein content between the left and right channel signals with the high level of similarity is completely cancelled when the left and right channel signals are added together.

8. An audio device for presenting a multichannel input signal, the audio device comprising:

a receiver that receives the multichannel input signal that includes a left channel signal, a right channel signal, a left surround channel signal, and a right surround channel signal;

an audio processor that extracts content that is present at similar levels but not in-phase between the left and right channel signals to produce a first enhancement signal, and extracts content that is present at similar levels but not in-phase between the left and right surround channel signals to produce a second enhancement signal;

a down-mixer that combines the left channel signal, the right channel signal, the left surround channel signal, the right surround channel signal, the first enhancement signal, and the second enhancement signal to produce a monophonic signal.

9. The audio device of claim 8, further comprising:

an attenuator that attenuates the left channel signal and the right channel signal by a first attenuation factor, attenuates the left surround channel signal and the right surround channel signal by a second attenuation factor, attenuates the first enhancement signal by a third attenuation factor, and attenuates the second enhancement signal by a fourth attenuation factor, wherein the second, third, and fourth attenuation factors are different than the first attenuation factor;

wherein the down-mixer receives the left channel signal, the right channel signal, the left surround channel signal, the right surround channel signal, the first enhancement signal, and the second enhancement signal from the attenuator.

10. The audio device of claim 8, wherein the multichannel input signal further includes a center channel signal and the down-mixer further combines the center channel signal with the left channel signal, the right channel signal, and the one of the left surround channel signal and the right surround channel signal to produce the monophonic signal.

11. The audio device of claim 8, further comprising a cross-fader that cross-fades between each of the channel signals of a multichannel presentation and the monophonic signal to cause the audio device to transition between the multichannel presentation and a monophonic presentation.

12. A method of transitioning between a stereophonic presentation and a monophonic presentation of a stereophonic input signal, the method comprising:

receiving the stereophonic input signal that includes a left channel signal and a right channel signal;

extracting content that is present at similar levels but not in-phase between the left and right channel signals to produce at least one of a left enhancement signal and a right enhancement signal;

combining the left channel signal, the right channel signal, and only one of the left enhancement signal and the right enhancement signal to produce a monophonic signal for the monophonic presentation.

13. The method of claim 12, further comprising:

attenuating the left channel signal and the right channel signal by a first attenuation factor; and attenuating the one of the left enhancement signal and the right enhancement signal by a second attenuation factor different than the first attenuation factor;

wherein the left channel signal, the right channel signal, and the one of the left enhancement signal and the right enhancement signal to be combined are attenuated before being combined.

14. The method of claim 12, further comprising cross-fading between the left channel signal and the monophonic signal and cross-fading between the right channel signal and the monophonic signal to transition between the stereophonic presentation and the monophonic presentation.

15. The method of claim 12, further comprising producing at least one of the left enhancement signal and the right enhancement signal by up-mixing the left channel signal and the right channel signal.

16. The method of claim 15 further comprising producing an identical left channel signal to the left channel signal and an identical right channel signal to the right channel signal by up-mixing the stereophonic input signal.

17. The method of claim 12 further comprising adding the left channel signal and the right channel signal together; and determining a level of similarity for content that is present but not in-phase between the left and right channel signals according to a cancellation of the content when the left channel signal and the right channel signal are added together.

18. The method of claim 17, wherein the extract content has a high level of similarity between the left and right channel signals, wherein content between the left and right channel signals with the high level of similarity is completely cancelled when the left and right channel signals are added together.

19. A method of transitioning between a multichannel presentation and a monophonic presentation of a multichannel input signal, the method comprising:

receiving the multichannel input signal that includes a left channel signal, a right channel signal, a left surround channel signal, and a right surround channel signal;

extracting content that is present at similar levels but not in-phase between the left and right channel signals to produce a first enhancement signal;

extracting content that is present at similar levels but not in-phase between the left and right surround channel signals to produce a second enhancement signal;

combining the left channel signal, the right channel signal, the left surround channel signal, the right surround channel signal, the first enhancement signal, and the second enhancement signal to produce a monophonic signal for the monophonic presentation.

20. The method of claim 19, further comprising:

attenuating the left channel signal and the right channel signal by a first attenuation factor; and attenuating the left surround channel signal and the right surround channel signal by a second attenuation factor different than the first attenuation factor;

attenuating the first enhancement signal by a third attenuation factor different than the first attenuation factor;

attenuating the second enhancement signal by a fourth attenuation factor different than the first attenuation factor;

wherein the left channel signal, the right channel signal, the left surround channel signal, the right surround channel signal, the first enhancement signal, and the second enhancement signal are attenuated before being combined.

21. The method of claim 19, wherein the multichannel input signal further includes a center channel signal and the center channel signal is further combined with the left channel signal, the right channel signal, and the one of the left surround channel signal and the right surround channel signal to produce the monophonic signal for the monophonic presentation.

22. The method of claim 19, further comprising cross-fading between each of the channel signals of the multichannel presentation and the monophonic signal to transition between the multichannel presentation and the monophonic presentation.

* * * * *